US009715809B2

(12) United States Patent
Pham et al.

(10) Patent No.: US 9,715,809 B2
(45) Date of Patent: Jul. 25, 2017

(54) FALL PROTECTION HARNESS WITH DAMAGE INDICATOR

(71) Applicant: Honeywell International Inc., Morris Plains, NJ (US)

(72) Inventors: Hai D. Pham, Eden Prairie, MN (US); Steve D. Huseth, Plymouth, MN (US); David Joseph Wunderlin, New Hope, MN (US)

(73) Assignee: Honeywell International Inc., Morris Plains, NJ (US)

( * ) Notice: Subject to any disclaimer, the term of this patent is extended or adjusted under 35 U.S.C. 154(b) by 0 days.

(21) Appl. No.: 14/962,671

(22) Filed: Dec. 8, 2015

(65) Prior Publication Data

US 2017/0162024 A1 Jun. 8, 2017

(51) Int. Cl.
*G08B 21/18* (2006.01)
*A62B 35/00* (2006.01)

(52) U.S. Cl.
CPC ..... *G08B 21/18* (2013.01); *A62B 35/0006* (2013.01)

(58) Field of Classification Search
CPC ..... G08B 21/18; A62B 35/0006
See application file for complete search history.

(56) References Cited

U.S. PATENT DOCUMENTS 6,006,860 A 12/1999 Bell
7,106,205 B2 9/2006 Graef et al.
8,665,097 B2 3/2014 Worthington et al.
8,902,074 B2 12/2014 Landry et al.
2008/0021718 A1* 1/2008 Kaartinen ..... G06Q 10/087 705/325
2010/0231402 A1 9/2010 Flynt et al.
2012/0050036 A1 3/2012 Landry et al.
2012/0081214 A1 4/2012 Alan
2013/0056302 A1 3/2013 Bishop
2015/0276521 A1 10/2015 Moore, Jr. et al.

FOREIGN PATENT DOCUMENTS

AU 2006207863 A1 9/2007
WO WO-2014/199341 A1 12/2014

OTHER PUBLICATIONS

"Iknaia Asset and Personnel Tracking Management System for the Construction Industry", [online]. Retrieved from the Internet: <URL http://www.iknaia.co.uk/wpcontent/uploads/2014/09/Iknaia-Construction.pdf, (2014), 8 pgs.
"Iknaia Construction—Tracking Assets and Workers", [online]. © Iknaia 2014. [retrieved on Oct. 7, 2015]. Retrieved from the Internet: <URL: http://www.iknain.co.uk/construction/, (2014), 2 pgs.

(Continued)

*Primary Examiner* — Leon Flores
(74) *Attorney, Agent, or Firm* — Schwegman Lundberg & Woessner, P.A.

(57) ABSTRACT

A fall protection harness has a magnetic sensor coupled to it, and a computer processor is coupled to the magnetic sensor. Upon damage to the fall protection harness, the magnetic sensor senses the damage, the magnetic sensor generates a first signal to the computer processor, and the computer processor generates a second signal indicating the damage.

17 Claims, 6 Drawing Sheets

(56) References Cited

OTHER PUBLICATIONS

"U.S. Appl. No. 15/012,437, Response filed Jan. 30, 2017 to Restriction Requirement mailed Jan. 1, 2017", 6 pgs.
"U.S. Appl. No. 15/012,437, Restriction Requirement mailed Jan. 17, 2017", 6 pgs.
"European Application Serial No. 17150486.3, Extended European Search Report mailed Mar. 28, 2017", 10 pgs.
"Radio-frequency identification—Wikipedia®", [online]. [retrieved on Dec. 17, 2015]. Retrieved from the Internet: <URL: https://web.archive.org/web/20151217225716/https://en.wikipedia.org/wiki/Radio-frequency_identification, (Dec. 17, 2015), 12 pgs.
"Safety Harnesses Get Smart", © 2006 RFID Journal, [online]. Retrieved from the Internet : <URL: http://www.rfidiournal.com/articles/view?2431>, (2006), 1 pg.
"European Application Serial No. 16199192.2, Extended European Search Report mailed Apr. 6, 2017", 7 pgs.
"U.S. Appl. No. 15/012,437, filed May 24, 2017 to Non Final Office Action mailed Feb. 24, 2017", 10 pgs.
"European Application Serial No. 17153064.5, Extended European Search Report mailed May 26, 2017", 6 pgs.

* cited by examiner

FALL PROTECTION HARNESS WITH DAMAGE INDICATOR

TECHNICAL FIELD

The present disclosure relates to fall protection harnesses, and in an embodiment, but not by way of limitation, a fall protection harness with a damage indicator.

BACKGROUND

Fall protection harnesses are critical pieces of safety equipment that are integral to preventing accidents on a job site. Fall protection harnesses provide a reliable restraint system worn by a worker that is connected to a fixed anchor point on a supporting structure, such as a building under construction. Fall protection harnesses are designed to arrest a fall of a worker quickly and safely. However, when a fall occurs, the fall protection harness causes a worker to be suspended in the fall harness in a potentially dangerous predicament. If there is no ladder or scaffolding for the worker to climb back onto, the worker will remain suspended until additional rescue help can be rendered. Being suspended in the fall harness for an extended period of time can lead to serious injury or death. Consequently, a rapid response is crucial to the safety of the worker. Also, a fall protection harness can be damaged or compromised when a fall occurs. Such damage should be brought to the attention of the proper person or authority, and the fall protection harness should be inspected and/or retired from use.

DETAILED DESCRIPTION

Figure 1:
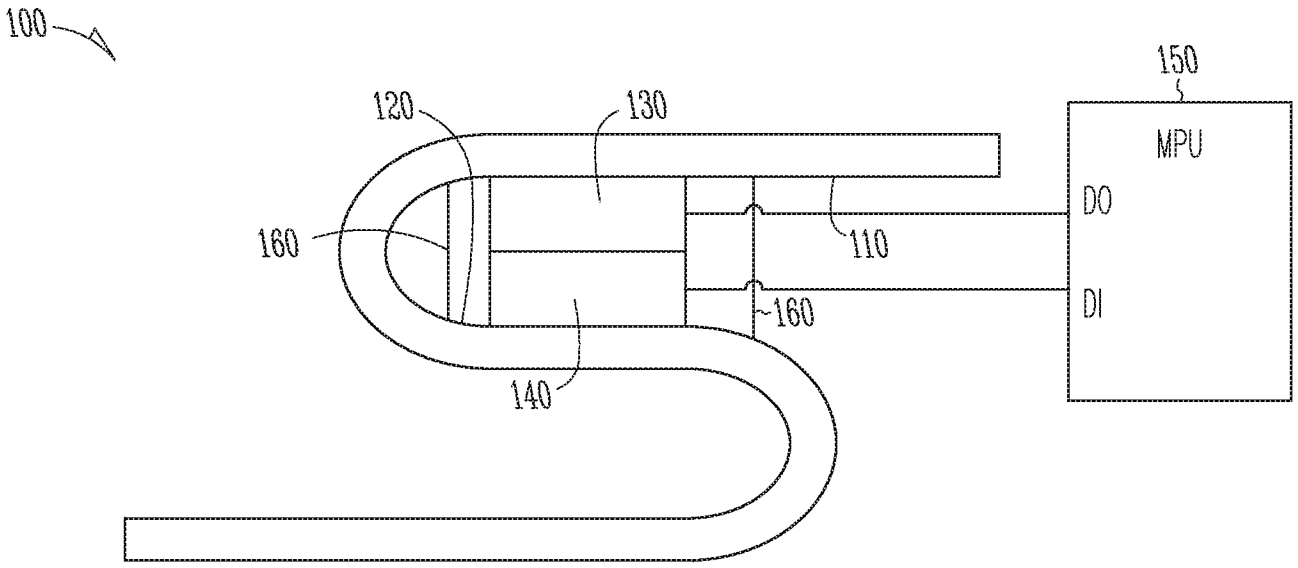
FIG. 1 illustrates a damage indicator coupled to a fall protection harness before any damage has occurred to the fall protection harness.

In the following description, reference is made to the accompanying drawings that form a part hereof, and in which is shown by way of illustration specific embodiments which may be practiced. These embodiments are described in sufficient detail to enable those skilled in the art to practice the invention, and it is to be understood that other embodiments may be utilized and that structural, electrical, and optical changes may be made without departing from the scope of the present invention. The following description of example embodiments is, therefore, not to be taken in a limited sense, and the scope of the present invention is defined by the appended claims.

An embodiment includes a sensor that is integrated into or attached to a fall protection harness. The sensor is capable of automatically sensing damage to the fall protection harness and/or a fall by a person wearing the fall protection harness. When damage is sensed, the fall protection harness can be examined to determine if it is still fit for further use, and when a fall is detected, a responsible person can be immediately notified of the fall event so that the person in the harness can be assisted. Notifying a responsible person of a fall event reduces the response time for help to arrive and consequently reduces the amount of time the person is suspended in the fall protection harness.

In an embodiment, a fall protection harness is constructed of nylon straps. At key locations on the harness, the nylon strap is folded over and attached (e.g., by sewing or an adhesive) onto itself to create a damage or fall indicator. In an embodiment, the damage or fall indicator is a paired magnet and reed dry contact material embedded by assembling via an adhesive and/or sewing them into the damage or fall indicator. Therefore, for example, when a worker falls from a height, the stitching of the damage or fall indicator breaks, the adhesive fails, and/or the sensors are structurally damaged, thereby causing the magnet to detach from the reed contact, and/or causing the sensors to cease operation. The reed conductor is then opened, and a signal is sent to an alarm device. A computer processor or other electronics module is attached to both sides of the damage or fall indicator on either side of the damage or fall indicator. When the magnet becomes detached from the reed conductor in the damage or fall indicator, the electronics module is engaged and begins to provide a damage or fall alarm. The damage or fall alarm may consist of visual, acoustic, and radio frequency (RF) signals being emitted by the device that will be detected by persons and equipment in the vicinity. In the case of damage to the fall protection harness that is not caused by a fall, the proper authorities are alerted that the fall protection harness should be inspected. In response to a fall by a person wearing a fall protection harness, rapidly alerting persons in the vicinity of the fall ensures rapid extraction of the fallen worker, thereby minimizing further injury and death.

Figure 2:
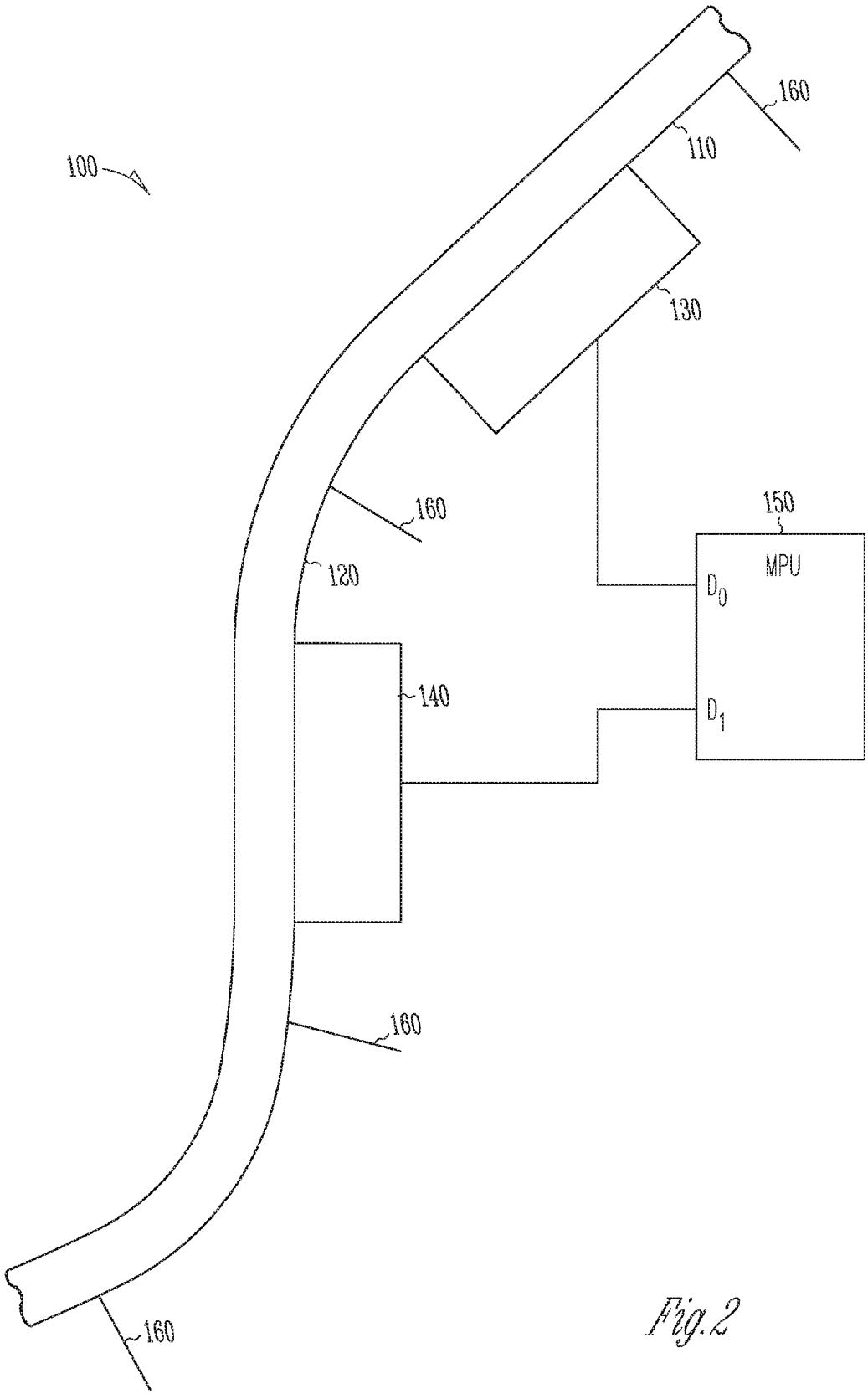
FIG. 2 illustrates a damage indicator coupled to a fall protection harness after damage has occurred to the fall protection harness.
Figure 3A:
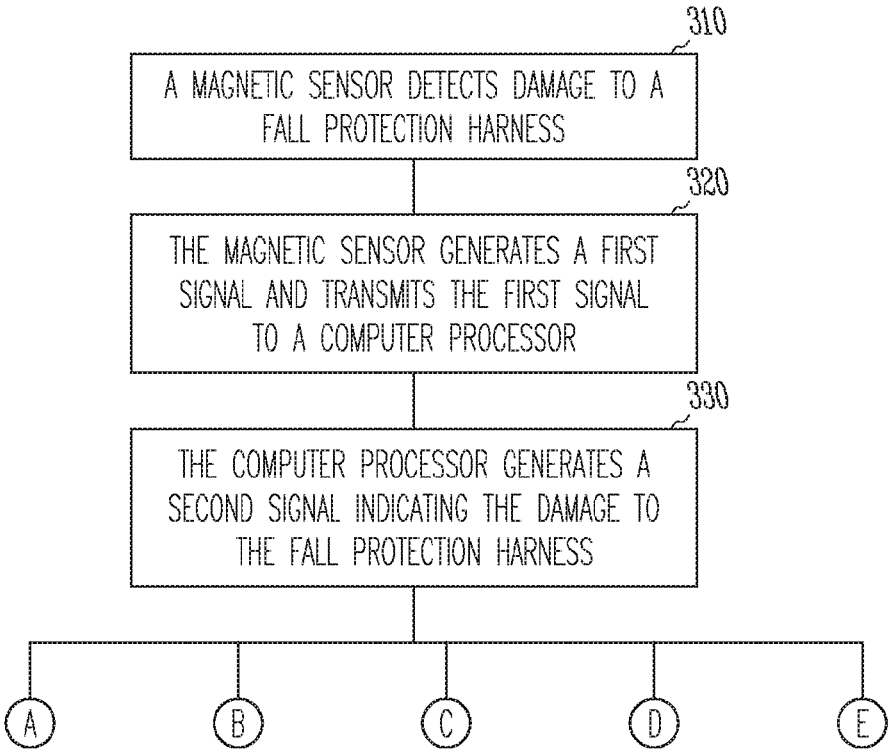
FIGS. 3A-3F illustrate features of a damage indicator for a fall protection harness.
Figure 3B:
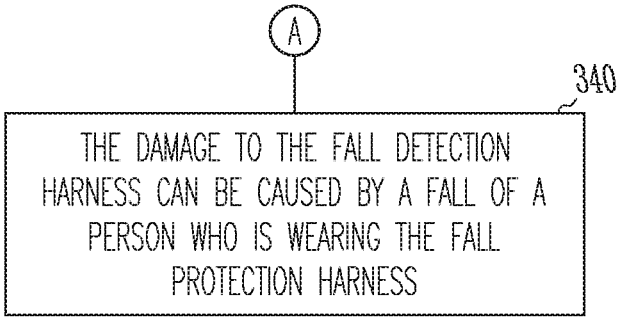
Figure 3C:
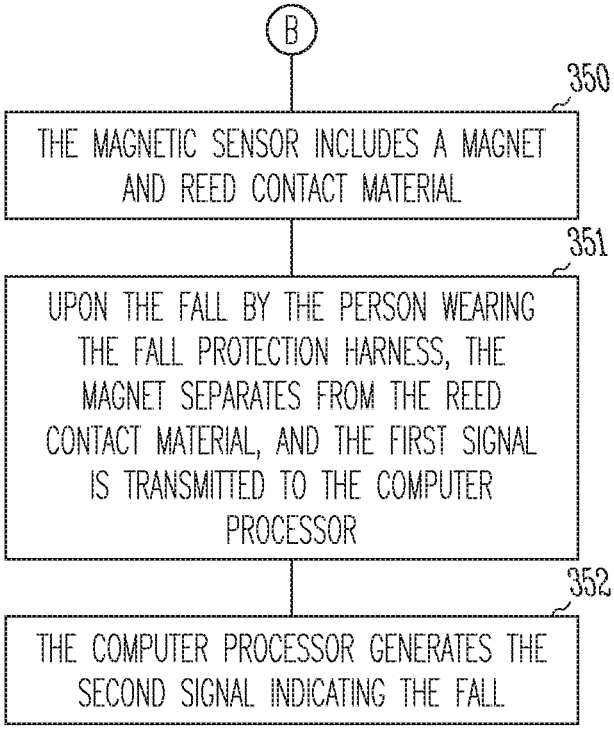
Figure 3D:
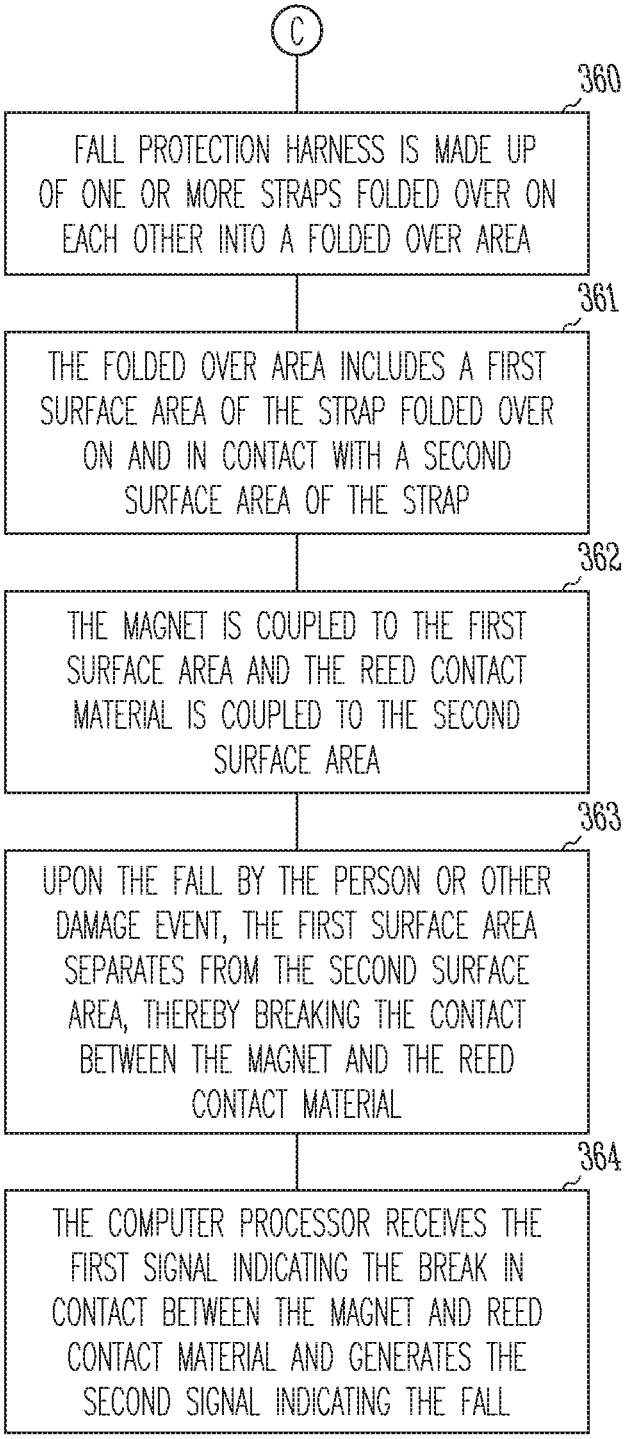
Figure 3E:
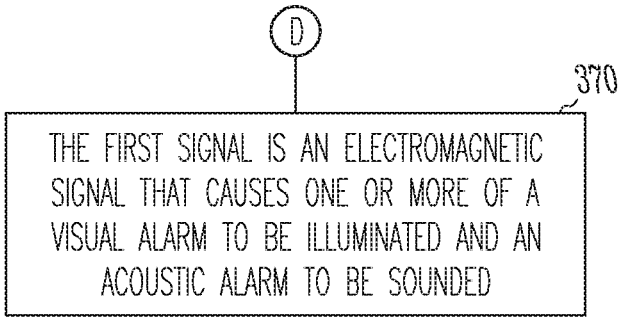
Figure 3F:
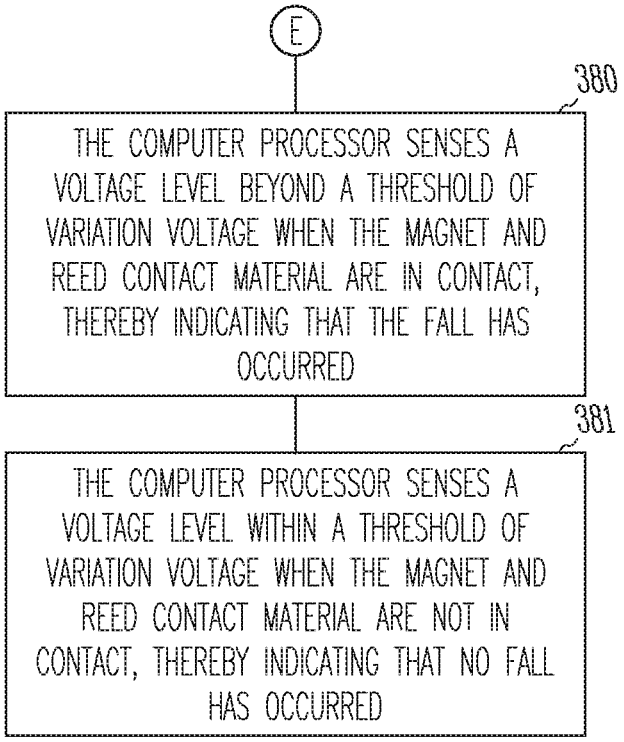

FIG. 1 illustrates a damage or fall indicator coupled to a fall protection harness before any damage has occurred to the fall protection harness, and FIG. 2 illustrates a damage or fall indicator coupled to a fall protection harness after damage has occurred to the fall protection harness. FIGS. 1 and 2 illustrate a strap 100 of a fall protection harness. The strap is folded over on itself, thereby forming a first surface 110 and a second opposing surface 120. The first surface 110 and second surface 120 are coupled to each other by threaded stitching 160 or other means of attachment. A first part of a magnetic sensor 130 is attached to the first surface 110, and a second part of the magnetic sensor 140 is attached to the second opposing surface 120. In an embodiment, the first part of the magnetic sensor is a magnet, and the second part of the magnetic sensor is a reed contact material. The first part of the magnetic sensor 130 and the second part of the magnetic sensor 140 are coupled to a micro-processing unit 150. Specifically, the first part of the magnetic sensor 130 is coupled to port DO of the micro-processing unit 150, and the second part of the magnetic sensor 140 is coupled to port DI of the micro-processing unit 150.

Upon a fall or other damage event to the fall protection harness, the threaded stitching 160 breaks, and the first surface 110 and the second surface 120 separate from each other, thereby also causing the first part of the magnetic sensor 130 and the second part of the magnetic sensor 140 to separate. See FIG. 2. In the case of a magnet and reed contact material, the separation of the first part of the magnetic sensor 130 and the second part of the magnetic sensor 140 causes the magnet to be detached from the reed conductor device. After separation, the MPU 150 senses 0 volts at the DI port. When the first part of the magnetic sensor 130 and the second part of the magnetic sensor 140 are intact, the first part 130 (that is, the magnet) pulls the second part (that is, the reed conductor device) in a closed state, and approximately half of a volt is sensed at port DO.

In different embodiments the system can be configured to sense different voltage values and to function based on those different voltage values. Additionally, the system can be conditioned to recognize a change in voltage outside a given range, rather than specific voltage values. The condition of the first part 130 and the second part 140 inside the folded over damage or fall indicator signals the MPU whether damage or a fall has occurred or not. Once a damage or fall condition is confirmed by the MPU 150, the MPU 150 signals the alarm mechanism to illuminate a visual alarm, sound an acoustic alarm, and/or transmit RF alarm signals.

FIGS. 3A-3F are a block diagram illustrating operations and features of a damage or fall indicator for a fall protection harness. FIGS. 3A-3F include a number of blocks 310-381. Though arranged substantially serially in the example of FIGS. 3A-3F, other examples may reorder the blocks, omit one or more blocks, and/or execute two or more blocks in parallel using multiple processors or a single processor organized as two or more virtual machines or sub-processors. Moreover, still other examples can implement the blocks as one or more specific interconnected hardware or integrated circuit modules with related control and data signals communicated between and through the modules. Thus, any process flow is applicable to software, firmware, hardware, and hybrid implementations.

At 310, a magnetic sensor detects damage to a fall protection harness. At 320, the magnetic sensor generates a first signal, which is transmitted to a computer processor. In an embodiment, the computer processor is a computer board that includes a radio frequency (RF) communication device. At 330, the computer processor or the computer board including the RF communication device generates a second signal indicating the damage to the fall protection harness.

Block 340 illustrates that the damage to the fall detection harness can be caused by a fall of a person who is wearing the fall protection harness. As indicated above, when such a fall is detected, help can be immediately dispatched to the person who has fallen.

Block 350 illustrates that, in an embodiment, the magnetic sensor includes a magnet and reed contact material, wherein the magnet is in contact with the reed contact material. Block 351 illustrates that the computer board including the RF communication device is operable such that upon the fall by the person wearing the fall protection harness, the magnet separates from the reed contact material, and the first signal is transmitted to the computer board including the RF communication device. Then, at 352, the computer board including the RF communication device generates the second signal indicating the fall.

Block 360 states that the fall protection harness is made up of one or more straps, and at least one of the straps is folded over on itself into a folded over area. The magnet and reed contact material are coupled to the strap within the folded over area. Block 361 shows that the folded over area includes a first surface area of the strap folded over on and in contact with a second surface area of the strap. Block 362 details that the magnet is coupled to the first surface area and the reed contact material is coupled to the second surface area. Then, as indicated at 363, upon the fall by the person or other damage event, the first surface area separates from the second surface area, thereby breaking the contact between the magnet and the reed contact material. At 364, the computer board comprising the RF communication device is operable to receive the first signal indicating the break in contact between the magnet and reed contact material and is operable to generate the second signal indicating the fall.

At 370, it is illustrated that the first signal is an electromagnetic signal, and the electromagnetic signal causes one or more of a visual alarm to be illuminated and an acoustic alarm to be sounded.

At 380, the computer board comprising the RF communication device senses a voltage level beyond a threshold of variation voltage when the magnet and reed contact material are in contact, thereby indicating that the fall has occurred. At 381, the computer board comprising the RF communication device senses a voltage level within a threshold of variation voltage when the magnet and reed contact material are not in contact, thereby indicating that no fall has occurred.

It should be understood that there exist implementations of other variations and modifications of the invention and its various aspects, as may be readily apparent, for example, to those of ordinary skill in the art, and that the invention is not limited by specific embodiments described herein. Features and embodiments described above may be combined with each other in different combinations. It is therefore contemplated to cover any and all modifications, variations, combinations or equivalents that fall within the scope of the present invention.

The Abstract is provided to comply with 37 C.F.R. §1.72(b) and will allow the reader to quickly ascertain the nature and gist of the technical disclosure. It is submitted with the understanding that it will not be used to interpret or limit the scope or meaning of the claims.

In the foregoing description of the embodiments, various features are grouped together in a single embodiment for the purpose of streamlining the disclosure. This method of disclosure is not to be interpreted as reflecting that the claimed embodiments have more features than are expressly recited in each claim. Rather, as the following claims reflect, inventive subject matter lies in less than all features of a single disclosed embodiment. Thus the following claims are hereby incorporated into the Description of the Embodiments, with each claim standing on its own as a separate example embodiment.

The invention claimed is:

1. A system comprising:

a fall protection harness;

a computer board comprising a radio frequency (RF) communication device coupled to the fall protection harness; and a magnetic sensor coupled to the fall protection harness and the computer board comprising the RF communication device;

wherein the magnetic sensor is operable to detect damage to the fall protection harness;

wherein the magnetic sensor generates a first signal to the computer board comprising the RF communication device; and wherein the computer board comprising the RF communication device generates a second signal indicating the damage; wherein the magnetic sensor comprises a magnet and reed contact material, the magnet in contact with the reed contact material; and wherein the computer board comprising the RF communication device is operable such that upon a fall by a person wearing the fall protection harness, the magnet separates from the reed contact material, the first signal is transmitted to the computer board comprising the RF communication device, and the computer board comprising the RF communication device generates the second signal indicating the fall.

2. The system of claim 1, wherein the damage to the fall detection harness is caused by a fall by a person wearing the fall protection harness.

3. The system of claim 1, wherein the fall protection harness comprises a strap, the strap folded over on itself into a folded over area, and the magnet and reed contact material are coupled to the strap within the folded over area.

4. The system of claim 3, wherein the folded over area comprises a first surface area of the strap folded over on and in contact with a second surface area of the strap;

wherein the magnet is coupled to the first surface area and the reed contact material is coupled to the second surface area;

wherein upon the fall by the person, the first surface area separates from the second surface area, thereby breaking the contact between the magnet and the reed contact material; and wherein the computer board comprising the RF communication device is operable to receive the first signal indicating the break in contact between the magnet and reed contact material and is operable to generate the second signal indicating the fall.

5. The system of claim 2, wherein the first signal comprises an electromagnetic signal, and the electromagnetic signal causes one or more of a visual alarm to be illuminated and an acoustic alarm to be sounded.

6. The system of claim 1, wherein the computer board comprising the RF communication device senses a voltage level beyond a threshold of variation voltage when the magnet and reed contact material are in contact, thereby indicating that the fall has occurred.

7. The system of claim 1, wherein the computer board comprising the RF communication device senses a voltage level within a threshold of variation voltage when the magnet and reed contact material are not in contact, thereby indicating that no fall has occurred.

8. A system comprising:

a fall protection harness;

a computer processor coupled to the fall protection harness; and a magnetic sensor coupled to the fall protection harness and the computer processor; wherein the computer processor is operable such that upon damage to the fall protection harness, the magnetic sensor senses the damage, the magnetic sensor generates a first signal to the computer processor, and the computer processor generates a second signal indicating the damage;

wherein the magnetic sensor comprises a magnet and reed contact material, the magnet in contact with the reed contact material; and wherein the computer processor is operable such that upon a fall by a person wearing the fall protection harness, the magnet separates from the reed contact material and the first signal is transmitted to the computer processor, and the computer processor receives the first signal and generates the second signal indicating the fall.

9. The system of claim 8, wherein the fall protection harness comprises a strap, the strap folded over on itself into a folded over area, and the magnet and reed contact material are coupled to the strap within the folded over area.

10. The system of claim 9, wherein the folded over area comprises a first surface area of the strap folded over on and in contact with a second surface area of the strap;

wherein the magnet is coupled to the first surface area and the reed contact material is coupled to the second surface area;

wherein upon the fall by the person, the first surface area separates from the second surface area, thereby breaking the contact between the magnet and the reed contact material; and wherein the computer processor is operable to receive the first signal caused by the break in contact between the magnet and reed contact material and generate the second signal indicating the fall.

11. The system of claim 8, wherein the first signal comprises an electromagnetic signal, and the electromagnetic signal causes one or more of a visual alarm to be illuminated and an acoustic alarm to be sounded.

12. The system of claim 8, wherein the computer processor senses a voltage level beyond a threshold of variation voltage when the magnet and reed contact material are in contact, thereby indicating that the fall has occurred.

13. The system of claim 8, wherein the computer processor senses a voltage level within a threshold of variation voltage when the magnet and reed contact material are not in contact, thereby indicating that no fall has occurred.

14. A non-transitory computer readable medium comprising instructions that when executed by a processor execute a process comprising:

receiving a first signal from a magnetic sensor coupled to a fall protection harness, the first signal generated as a result of the magnetic sensor sensing damage to the fall protection harness; and generating a second signal indicating the damage to the fall protection harness;

wherein the magnetic sensor comprises a magnet and reed contact material, the magnet in contact with the reed contact material; and wherein the computer processor is operable such that upon a fall by a person wearing the fall protection harness, the magnet separates from the reed contact material and the first signal is transmitted to a computer processor, and the computer processor receives the first signal and generates the second signal indicating the fall.

15. The non-transitory computer readable medium of claim 14, wherein the fall protection harness comprises a strap, the strap folded over on itself into a folded over area, and the magnet and reed contact material are coupled to the strap within the folded over area; and wherein the folded over area comprises a first surface area of the strap folded over on and in contact with a second surface area of the strap;

wherein the magnet is coupled to the first surface area and the reed contact material is coupled to the second surface area;

wherein upon the fall by the person, the first surface area separates from the second surface area, thereby breaking the contact between the magnet and the reed contact material; and wherein the computer processor is operable to receive the first signal caused by the break in contact between the magnet and reed contact material and generate the second signal indicating the fall.

16. The non-transitory computer readable medium of claim 14, comprising instructions for sensing a voltage level beyond a threshold of variation voltage when the magnet and reed contact material are in contact, thereby indicating that the fall has occurred.

17. The non-transitory computer readable medium of claim 14, comprising instructions for sensing a voltage level within a threshold of variation voltage when the magnet and reed contact material are not in contact, thereby indicating that no fall has occurred.

* * * * *